US008319652B2

(12) United States Patent
Oh et al.

(10) Patent No.: US 8,319,652 B2
(45) Date of Patent: Nov. 27, 2012

(54) IMAGE NOTIFICATION ON SECURITY PANEL FOR PROTECTED ASSETS

(75) Inventors: Eric Oh, Syosset, NY (US); Ron Rothman, Smithtown, NY (US)

(73) Assignee: Honeywell International Inc., Morristown, NJ (US)

( * ) Notice: Subject to any disclaimer, the term of this patent is extended or adjusted under 35 U.S.C. 154(b) by 533 days.

(21) Appl. No.: 12/629,600

(22) Filed: Dec. 2, 2009

(65) Prior Publication Data

US 2011/0128157 A1 Jun. 2, 2011

(51) Int. Cl.

| | |
|---|---|
| ***G08B 3/00*** | (2006.01) |
| ***G08B 5/00*** | (2006.01) |
| ***G08B 7/00*** | (2006.01) |

(52) U.S. Cl. ..... 340/691.1; 340/541; 340/568.1

(58) Field of Classification Search ..... 340/691.1
See application file for complete search history.

(56) References Cited

U.S. PATENT DOCUMENTS

| | | | | |
|---|---|---|---|---|
| 2005/0246418 | A1 * | 11/2005 | Tanaka et al. | 709/203 |
| 2006/0017565 | A1 | 1/2006 | Addy | |
| 2007/0085676 | A1 | 4/2007 | Lee et al. | |

FOREIGN PATENT DOCUMENTS

| | | | |
|---|---|---|---|
| EP | 0 488 178 | A2 | 6/1992 |
| WO | WO 2006/034246 | A2 | 3/2006 |
| WO | WO 2006/034246 | A3 | 3/2006 |
| WO | WO 2007/056060 | A2 | 5/2007 |
| WO | WO 2007/056060 | A3 | 5/2007 |
| WO | WO 2008/054734 | A2 | 5/2008 |
| WO | WO 2008/054734 | A3 | 5/2008 |

OTHER PUBLICATIONS

Partial European Search Report corresponding to Application No. EP 10 19 1224, dated Jan. 31, 2011.

* cited by examiner

*Primary Examiner* — Travis Hunnings
(74) *Attorney, Agent, or Firm* — Husch Blackwell

(57) ABSTRACT

A method and apparatus for use with a security system. The method includes the steps of providing a plurality of sensors within the security system where each sensor of the plurality of sensors is associated with an asset, detecting activation of a sensor of the plurality of sensors and displaying an image of the asset associated with the activated sensor.

20 Claims, 1 Drawing Sheet

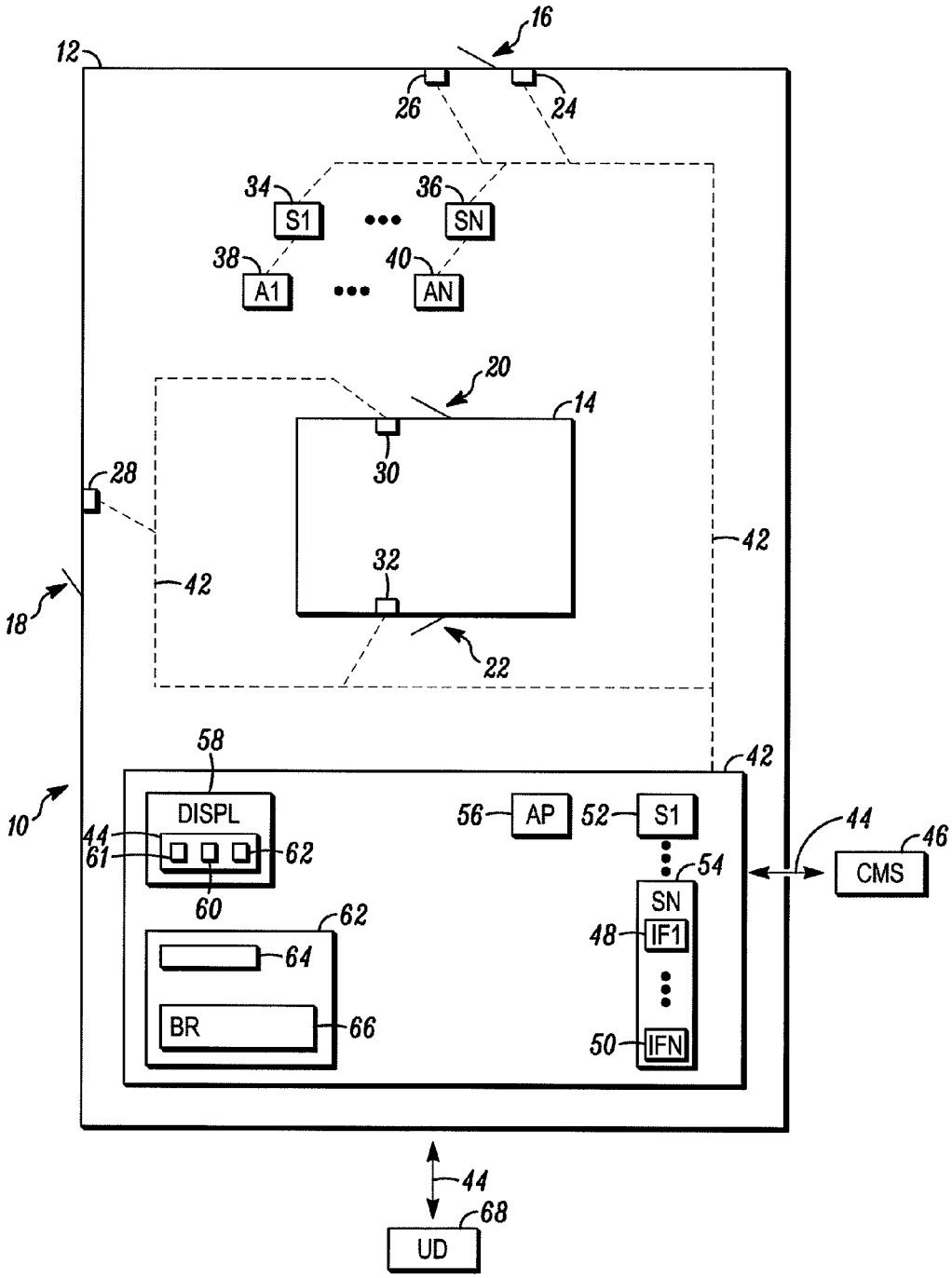
16
12
26
24
34
S1
36
SN
38
A1
40
AN
20
14
30
28
42
32
42
18
22
58
42
10
DISPL
56
AP
52
S1
44
61
62
44
46
54
CMS
60
SN
62
48
IF1
64
BR
66
50
IFN
44
68
UD

IMAGE NOTIFICATION ON SECURITY PANEL FOR PROTECTED ASSETS

FIELD OF THE INVENTION

The field of the invention relates to security systems and more particularly to security panel displays.

BACKGROUND OF THE INVENTION

Security systems are generally known. Such systems are typically used to protect people or assets.

Security systems typically include the use of a physical barrier (e.g., fence, walls, etc.) that surround a secured area. One or more access points or openings (e.g., doors) may be provided in the physical barrier for entry or egress of people and/or assets. The access points may be provided with one or more sensors to detect opening of the access points for entry and egress of people and/or assets.

Located near one or more of the access points may be a keypad for arming or disarming the security system. The keypad and sensors may be connected to an alarm panel located somewhere within the secured area. Once armed, the alarm panel may monitor the sensors and keypad for activation. If a sensor is activated, then the alarm panel may activate an audible alarm or wait a time period before activation of the alarm to allow for entry of a deactivation code by an authorized person through the keypad.

In addition to activating a local audible alarm, the alarm panel may also send an alarm notification message to a central monitoring station. In response, the central monitoring station may alert a private security service or dispatch the police.

In addition to a keypad, most alarm panels provide a display for status information. The status information may include an indication of whether the alarm is in an armed or disarmed state and identification of any zones with activated sensors.

While such indication is effective for a person familiar with the secured area, it is of no help to a stranger or where time is of the essence. Accordingly, a need exists for better display of details of detected alarms and the features of associated alarm zones.

BRIEF DESCRIPTION OF THE DRAWINGS

FIG. 1 is a block diagram of a security system shown generally in accordance with an illustrated embodiment of the invention.

DETAILED DESCRIPTION OF AN ILLUSTRATED EMBODIMENT

FIG. 1 is a block diagram of a security system 10 used for protecting a secured area 12 shown generally in accordance with an illustrated embodiment of the invention. Included within the outer secured area 12 may be one or more inner secured areas 14. In general, the inner secured areas 14 may have a higher relative security level than the outer secured area 12.

The secured areas 12, 14 may have one or more access points 16, 18, 20, 22 (e.g., doors) through which authorized persons may enter and egress from the secured areas 12, 14. Associated with at least one of the access points 16, 18, 20, 22 may be an identification reader (e.g., keypad, card reader, fingerprint or iris scanner, etc.) 24 for arming and disarming the system 10. Where the identification reader is a keypad 24, then an authorized person may enter a first numeric code to arm the system 10 and a second numeric code to disarm the system 10.

Also included within the secured areas 12, 14 may be a number of security sensors 26, 28, 30, 32 that are associated with the access points 16, 18, 20, 22. In each case, opening a door of the access points 16, 18, 20, 22 activates a corresponding security sensor 26, 28, 30, 32.

The secured areas 12, 14 may also include a number of security sensors 34, 36 that are each associated with a respective asset 38, 40 located within the one or more secured areas 12, 14. In this case, the security sensors 34, 36 are designed to detect movement or other tampering with the associated asset 38, 40.

For example, the asset 38, 40 may be any high value asset (e.g., a safe, computer, etc.) that could be subject to theft. The associated sensor 34, 36 may be an electrical switch that detects movement of the asset 38, 40, an infrared detector that detects personnel in the area of the asset or a proximity detector or use contact that detects unauthorized persons accessing the asset 38, 40. Alternatively, the associated sensor 34, 36 may be a microwave device that detects motion proximate the asset 38, 40 via Doppler frequency shifts.

The identification reader 24 and sensors 26, 28, 30, 32, 34, 36 are connected to an alarm panel 42 via a communication link 42. The communication link 42 may be provided in the form of a set of electrical conductors or the link 42 may be wireless including a pair radio frequency transceivers on opposing ends of each connection between the alarm panel 42 and devices 24, 26, 28, 30, 32, 34, 36.

In order to use the system 10, an authorized user may enter an arming code through the identification reader 24. The alarm panel 42 receives the arming code and compares the entered code with a reference code saved in a memory. If the entered code matches the saved code, then the alarm panel 42 may set an audible message through the identification reader 24 notifying the person that the system 10 is about to arm and beginning a time period that allows the user to egress through the access point 16 before the system 10 becomes armed.

Once the system 10 becomes armed, the alarm panel 42 continuously monitors the alarm sensors 26, 28, 30, 32, 34, 36. If a sensor 26, 28, 30, 32, 34, 36 is activated, either by opening the door of an access point 16, 18, 20, 22 or by tampering with an asset 38, 40, then the alarm panel 42 enters an alarm mode. Upon entering an alarm mode, the alarm panel 42 may send an alarm notification message 44 including an identifier of the sensor 26, 28, 30, 32, 34, 36, an identifier of the system 10 and the current time to a central monitoring station 46. The central monitoring station 46 may respond in a conventional manner by dispatching a private security guard or alerting a local police department.

Similarly, an authorized person may enter the secured area 12 through access point 16 and enter a disarm code through the identification reader 24. In this case, the alarm panel 42 may enter a delay period to allow entry of the disarm code through the identification reader 24. Once inside, the person may again arm the system 10.

Under an illustrated embodiment of the invention, the alarm panel 42 contains one or more images files 48, 50 on computer readable medium (memory) within the panel 42. In this regard, each sensor 26, 28, 30, 32, 34, 36 of the security system 10 may have a respective sensor file 52, 54 containing one or more associated image files 48, 50. In effect, the image file 48, 50 corresponds to and illustrates (in pictorial form) a particular area or asset 38, 40 protected by the security sensor 26, 28, 30, 32, 34, 36. The association of the sensor 26, 28, 30, 32, 34, 36 with the image file 48, 50 is accomplished by saving a predetermined image file 48, 50 within the respective file 52, 54 of some or all of the sensors 26, 28, 30, 32, 34, 36.

For example, when a prior security system detects an alarm or trouble with a sensor, the system typically displays a numerical or short text description of an alarm zone or area 12, 14. Similarly, it is usually the numeric or short text description that is sent to the central monitoring station.

Under the illustrated embodiment, the alarm notification 44 is linked to an image file 48, 50. The link may be direct where the image file 48, 50 is included within the alarm notification message 44 or the file 48, 50 may be hyperlinked to the message 44.

In either case, once the alarm panel 42 detects activation of a sensor 26, 28, 30, 32, 34, 36, an alarm processor 56 within the alarm panel 42 searches the sensor file 52, 54 of the activated sensor for any image files 48, 50. Once any image file 48, 50 is detected, the alarm processor 56 composes an alarm notification message 44 that is sent to a display 58 of the alarm panel 42 and/or sent to the central monitoring station 46. The alarm notification message 44 may include, and display an identifier 61 of the sensor 26, 28, 30, 32, 34, 36 and the image 60 of the image file 48, 50 and/or a hyperlink 62 to the associated image file 48, 50 and a time stamp. In the case where a sensor has a number of images associated with the sensor, the hyperlink 62 may be used to sequence through the images thereby allowing the person to view one image at a time without overcrowding the display 58.

In addition to sending the alarm notification to the central station 46, the alarm processor 56 may also send the notification to a user device 68. The user device 68 may be a cell phone or personal computer (PC) that is coupled to the alarm system 10 wirelessly or through the Internet.

Moreover, where the user device 68 is a PC, the user may access the alarm panel 42 via a web site maintained within the alarm panel 42 or central monitoring station 46. In either case, the user may use the PC 68 to monitor a status of the alarm panel 42. In each case, the alarm panel 42 may provide an image of each zone along with an icon that allows the user to open an image file 48, 50 of the zone 12, 14.

In addition to displaying images, the system 10 provides authorized persons with the ability to create and store picture images (e.g., color images) of protected assets and property in the alarm panel 42 that are (in turn) displayed on a color display 58 when the protected item or zone goes into alarm. Image notification and presentation eliminates confusion and misidentification of violated assets and properties compared to text-only notification.

For example, prior systems merely used short text messages or zone numerical identifiers for alarm notification. In contrast, the person (or police) responding to the alarm message had very little knowledge of the alarm system. By presenting an image 60 of the alarm zone, the responder has visual queues as to the nature of the environment of the security threat.

The association of images 48, 50 with sensors 26, 28, 30, 32, 34, 36 can be accomplished quickly and easily. For example, the alarm panel 42 may be provided with a terminal 62 with a CD reader 64. Images may be written onto a CD and read into the alarm panel 42 via the CD reader 64. A browser 66 within the terminal 42 may be used to save the images 48, 50 into the appropriate sensor file 52, 54.

A specific embodiment of method and apparatus for presenting images on a display in a security system has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

creating and storing an image in memory for each of a plurality of assets;

providing a plurality of sensors within a security system where each sensor of the plurality of sensors is associated with a respective asset of the plurality of assets and with the stored image of the asset in memory;

an alarm panel detecting activation of a sensor of the plurality of sensors; and an alarm panel display displaying the stored image of the asset associated with the activated sensor.

2. The method as in claim 1 further comprising detecting a trouble condition associated with the asset and, in response, displaying the image of the asset.

3. The method as in claim 1 further comprising a sensor of the plurality of sensors disposed on an access opening of a secured area containing the associated asset.

4. The method as in claim 3 wherein the image further comprises an image of the secured area showing the asset.

5. The method as in claim 4 wherein the image further comprises an image of the secured area showing a plurality of assets.

6. The method as in claim 1 further comprising activating a hyperlink to retrieve the displayed image.

7. The method as in claim 6 further comprises activating a hyperlink to sequence through a plurality of displayed images.

8. The method as in claim 1 wherein the display further comprises a user device.

9. The method as in claim 1 wherein the display further comprises a cell phone.

10. An apparatus comprising:

an image stored in memory for each of a plurality of assets;

a plurality of sensors within a security system where each sensor of the plurality of sensors is associated with a respective asset of the plurality of assets and with the stored image of the respective asset;

an alarm processor that detects activation of a sensor of the plurality of sensors and displays the stored image of the asset associated with the activated sensor in conjunction with alarm message.

11. The apparatus as in claim 10 further comprising detecting a trouble condition associated with the asset and, in response, displaying the image of the asset.

12. The apparatus as in claim 10 further comprising a sensor of the plurality of sensors disposed on an access opening of a secured area containing the associated asset.

13. The apparatus as in claim 12 wherein the image further comprises an image of the secured area showing the asset.

14. The apparatus as in claim 13 wherein the image further comprises an image of the secured area showing a plurality of assets.

15. The apparatus as in claim 10 further comprising a hyperlink that retrieves that display image.

16. The apparatus as in claim 10 further comprising a hyperlink that sequences through a plurality of displayed images.

17. The apparatus as in claim 10 wherein image further comprises a user device.

18. The apparatus as in claim 10 wherein the image further comprises a cell phone.

19. An apparatus comprising:

an image stored in memory for each of a plurality of assets;

a plurality of sensors within a security system where each sensor of the plurality of sensors is associated with a respective asset of the plurality of assets and with the stored image of the respective asset;

means for detecting activation of a sensor of the plurality of sensors and displaying the stored image of the asset associated with the activated sensor.

20. The apparatus as in claim 19 further comprising detecting a trouble condition associated with the asset and, in response, displaying the image of the asset.

* * * * *